United States Patent [19]

Swenson et al.

[11] Patent Number: 4,692,212

[45] Date of Patent: Sep. 8, 1987

[54] KRAFT LINERBOARD BY DENSIFICATION AND HEAT TREATMENT

[75] Inventors: Roy S. Swenson, Ringwood, N.J.; Donald M. MacDonald, Monroe, N.Y.; Michael Ring, Warwick, N.Y.; Jasper H. Field, Goshen, N.Y.

[73] Assignee: International Paper Company, New York, N.Y.

[21] Appl. No.: 768,776

[22] Filed: Aug. 23, 1985

[51] Int. Cl.[4] ..... D21F 11/00

[52] U.S. Cl. ..... 162/206; 162/207

[58] Field of Search ..... 162/13, 28, 100, 142, 162/150, 206, 207; 34/23, 12

[56] References Cited

U.S. PATENT DOCUMENTS 3,319,352 5/1967 Haigh ..... 162/206

FOREIGN PATENT DOCUMENTS 1424682 2/1976 United Kingdom ..... 162/206

*Primary Examiner*—Peter Chin

*Attorney, Agent, or Firm*—Walt Zielinski; Charles Fallow

[57] ABSTRACT

Both the wet strength and the folding endurance of kraft linerboard are improved by subjecting the board to steps of densification and high temperature treatment during its production.

11 Claims, 2 Drawing Figures

KRAFT LINERBOARD BY DENSIFICATION AND HEAT TREATMENT

BACKGROUND OF THE INVENTION

1. Field of the Invention:

This invention relates to the art of papermaking, particularly to treating kraft linerboard with pressure and heat to improve its wet strength while preserving its folding endurance.

2. Description of the Prior Art:

The kraft process is a method of preparation of an aqueous slurry of fibers by treatment of a suitable renewable raw material. In most pulping process, a considerable portion of the natural lignin wood, grass or other vegetative matter is rendered soluble by chemical reaction with one or more nucleophilic reagents. In the kraft process, the nucleophilic reagents are sulfide and hydroxide ions, which are used under highly alkaline conditions. Variations of the kraft process include the earlier practiced soda process, using hydroxyl ions derived from metals in Group IA of the periodic table, namely lithium, sodium, potassium, rubidinium and cesium. A second variation involves the use of anthraquinone (AQ) or substituted anthraquinones as additional nucleophiles. Anthraquinone can be used in the soda process, in which case the process is known as the soda-AQ process, or in the kraft process which is then known as the kraft-AQ process. Such variations in the kraft process are well known in the industry and pulps prepared by any of these variations can be used in practicing the present invention.

Linerboard is medium-weight paper product used as the facing material in corrugated carton construction. "Kraft linerboard" is linerboard made from pulp produced by the kraft process.

In the art of making kraft linerboard, it is conventional to subject felted fibers to wet pressing to unite the fibers into a coherent sheet. Pressure is typically applied to a continuous running web of paper by a series of nip rolls which, by compressing the sheet, both increase its volumetric density and reduce its water content. The accompanying FIG. 1 shows in simplified diagrammatic form a typical papermaking machine, including a web former and three representative pairs of wet press rolls. Also shown are drying rolls whose purpose is to dry the paper to a desired final moisture content, and a calender stack to produce a smooth finish. At least some of the rolls are ordinarily heated to hasten drying. (The drawing is simplified—there are many more drying rolls in actual practice.)

There is currently considerable interest in treatments involving heat and pressure, or heat alone, during or after the production process, to improve various qualities of linerboard. Quantifiable board qualities include dry tensile strength, wet tensile strength, reverse folding endurance, compressive strength and stiffness, among others. Which qualities should desirably be enhanced depends upon the intended application of the product. For linerboard to be used in manufacturing corrugated cartons for use in humid or wet environments, three qualities of particular interest are wet strength, folding endurance and high humidity compression strength, all of which can be measured by well-known standard tests. As used herein, then, "wet strength" means wet tensile strength as measured by American Society for Testing and Materials (ASTM) Standard D829-48. "Folding endurance" is defined as the number of times a board can be folded in two directions without breaking, under conditions specified in Standard D2176-69. "Compression strength" is edgewise linear compression strength as measured by a standard STFI (Swedish Forest Research Institute) Tester. "Basis weight" is the weight per unit area of the dried end product. Prior workers in this field have recognized that high-temperature treatment of linerboard can improve its wet strength. See, for example E. Back, "Wet stiffness by heat treatment of the running web", *Pulp & Paper Canada,* vol. 77, No. 12, pp. 97–106 (Dec. 1976). This increase has been attributed to the development and cross-linking of naturally occurring polysaccharides and other polymers, which phenomenon may be sufficient to preserve product wet strength even where conventional synthetic formaldehyde resins or other binders are entirely omitted.

It is important to note that wet strength improvement by heat curing has previously been thought attainable only at the price of increased brittleness (i.e., reduced folding endurance). Therefore, most prior high-temperature treatments have been performed on particle board, wallboard, and other products not to be subjected to flexure. The known processes, if applied to linerboard, would produce a brittle product. Embrittled paper-board is not acceptable for many applications involving subsequent deformation such as the converting operation on a corrugating machine to make corrugated boxes out of linerboard, and therefore heat treatment alone, to develop wet strength of linerboard, has not gained widespread acceptance. As Dr. Back has pointed out in the article cited above, "The heat treatment conditions must be selected to balance the desirable increase in wet stiffness against the simultaneous embrittlement in dry climates." Significantly, in U.S. Pat. No. 3,875,680, Dr. Back has disclosed a process for heat treating already manufactured corrugated board to set previously placed resins, the specific purpose being to avoid running embrittled material through a corrugator.

It is plain that added wet strength and improved folding endurance were previously thought incompatible results.

It is therefore an object of the invention to produce linerboard having both greatly improved wet strength and good folding endurance. Another goal is to achieve that objective without resorting to synthetic resins or other added binders and wet strength agents.

With a view to the foregoing, a process has been developed which dramatically and unexpectedly increases not only the wet strength of linerboard, but also preserves its folding endurance. In its broadest sense, the invention comprises steps of (1) subjecting linerboard produced from unbleached kraft pulp to high pressure densification, and (2) heating the board to an internal temperature of at least 420° F. (216° C.) for a period of time sufficient to increase the wet strength of the board.

This method produces a product having folding endurance greatly exceeding that of similar board whose wet strength has been increased by heat alone. This is clearly shown by our tests exemplified below.

While the tests set out in Examples 1–3 have carried out the invention in a static press, it is preferred that the heat and pressure be applied to continuously running board by hot pressure rolls as shown in Example 4, inasmuch as much higher production rates can be attained.

We prefer to raise the internal temperature of the board at least 550° F. (289° C.), as greater wet strength is then achieved. This may be because at higher temperatures, shorter step duration is necessary to develop bonding, and there is consequently less time for fiber degradation to occur. Also, shorter durations enable one to achieve higher production speeds.

It should be noted that the heating rate, and thus the required heating duration at a particular temperature, depends on method of heat transfer chosen. Furthermore, it is desirable to raise the web temperature as rapidly as possible to the chosen treating temperature. Improved heating rates can be achieved by using high roll temperatures and/or by applying high nip forces to the press roll against the sheet on the hot rolls. That high pressure dramatically improves heat transfer rates has previously been disclosed. One worker has attributed this to the prevention of vapor formation at the web-roll interface.

While the invention may be practiced over a range of temperatures, pressures and durations, these factors are interrelated. For example, the use of higher temperatures requires a heating step of shorter duration, and vice-versa. At 550° F., a duration of 2 seconds has been found sufficient to obtain the desired improvements, while at 420° F., considerably longer time is required.

It is presently preferred that, for safety reasons, the roll temperature be not greater than the web ignition temperature (572° F., 300° C.); however, even higher roll temperatures may be used if suitable precautions, such as the provision of an inert atmosphere, or rapid removal of paper from the hot environment, are taken.

DESCRIPTION OF THE PREFERRED EMBODIMENT

Figure 1:
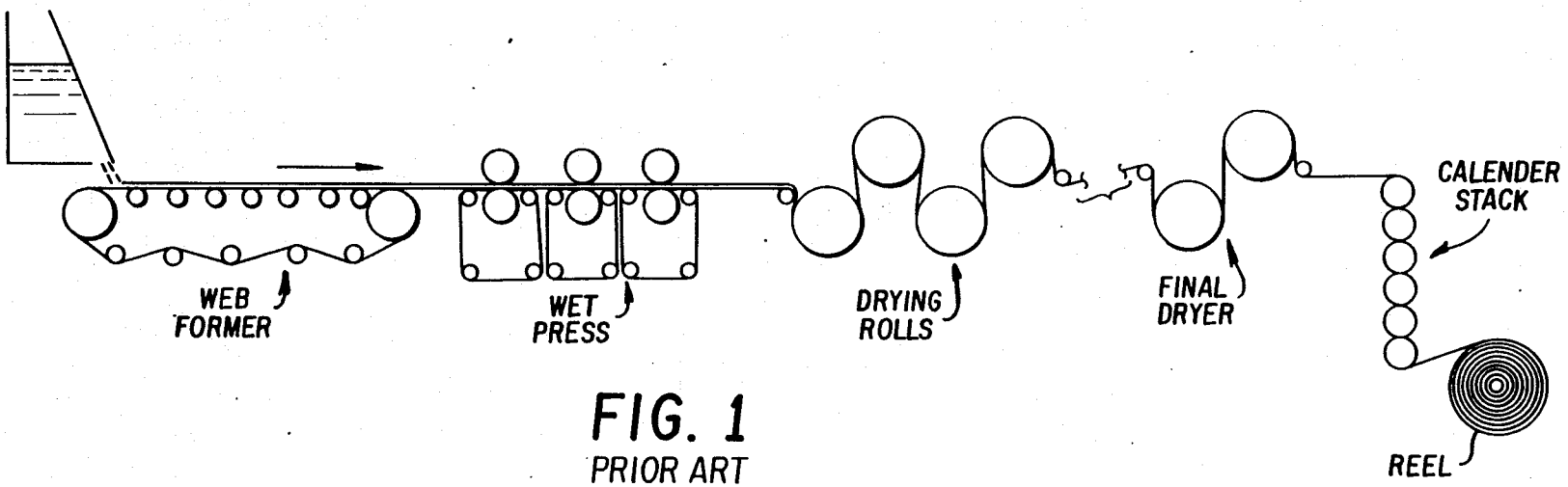
FIG. 1 PRIOR ART
FIG. 1 shows, in greatly simplified diagrammatic form, a conventional apparatus for producing linerboard.
Figure 2:
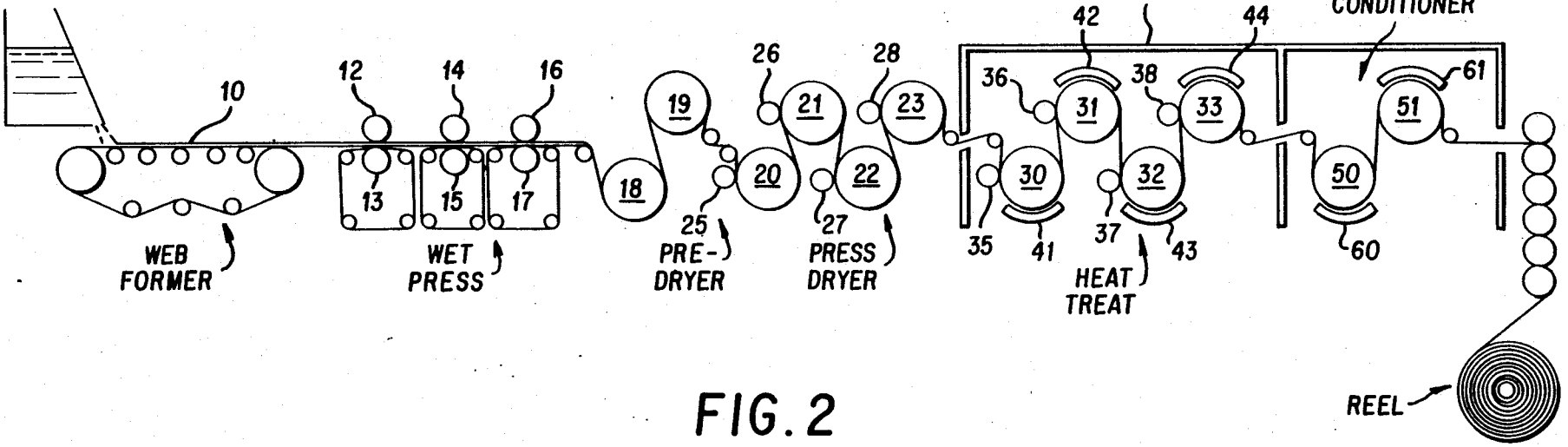
FIG. 2 shows, in like diagrammatic form, an apparatus for practicing the present invention.

FIG. 2 illustrates a preferred apparatus for carrying out the inventive process, although it should be understood that other devices, such as platen presses, can be used and in fact some of the data below was obtained from platen press tests. In the machine depicted, unbleached kraft pulp fibers in aqueous suspension are deposited on a web former screen 10, producing a wet mat of fibers. The mat is then passed through a series of wet press nip rolls 12, 13, 14, 15, 16 and 17 which develop a consolidated web. Suitable wet presses known today includes long nip presses and shoe-type presses capable of developing high unit press pressures on the wet fiber web. This step is known as "high pressure wet pressing". The web is then passed over pre-drying rolls 18, 19 to remove water from the wet web. Once the moisture content of the web has been reduced to less than 70% by weight, high pressure densification and high temperature treatment are applied according to the invention.

To densify the web, a series of drying rolls 20, 21, 22, 23 are provided with respective pressure rollers 25, 26, 27, 28 which are loaded sufficiently to produce a web density of at least 700 kg/m$^3$. We define this step as "press drying". In the preferred embodiment, the high pressure densification step of the invention is carried out both at normal drying temperatures (substantially below 400° F.) in the press drying section, and also in the high temperature heat treatment section described below. It should be understood, however, that the two steps may be performed sequentially or simultaneously.

In the heat treatment section, one or more drying rolls (e.g. 30, 31, 32, 33) is heated to or slightly above the desired maximum internal web temperature. Pressure rolls 35, 36, 37, 38 are used to improve heat transfer between the drying rolls and the web, and preferably, these pressure rolls are also highly loaded to continue the high pressure densification step during heat treatment. The drying roll temperature necessary to achieve target web temperature is a function of several factors including web thickness, web moisture, web entering temperature, web speed, nip pressure, and roll diameter; its calculation is within the skill of the art. It is presently believed optimum to achieve an internal web temperature of 550° F. (289° C.) and to maintain such temperature for two seconds. In any event, the roll temperature must be at least 420° F. (221° C.) which is well in excess of the temperature of normal drying rolls. The heat treatment rollers are contained within an envelope 40, and air caps 41, 42, 43, 44 may be used to heat the web further as it passes over the rolls. An inert gas, steam or superheated steam atmosphere may be used for this purpose and to prevent oxidation or combustion at high temperatures.

Following heat treatment, the web may be passed over final rolls 50, 51 having air caps 60, 61 to condition the web, which is then calendered and reeled in a conventional manner.

The combined effect of high pressure densification and high temperature produce an unexpected combination of good wet strength and good folding endurance in the finished product.

The invention has been practiced as described in the following examples. The improvement in board quality will be apparent from an examination of the test results listed in the tables below.

EXAMPLE 1

Pine woods chips from the southeastern United States were cooked by the kraft process to an extent typical of pulp used in linerboard production. The cooked chips were converted to a pulp by passage through a disk refiner. The pulp was thoroughly washed with water to remove residual black liquor and was stored in the wet state at 38°–42° F. (3°–6° C.) in a refrigerator until sheets were prepared. The cooked, washed pulp had a kappa number of 98, indicating presences of 15% residual lignin and had a freeness of 720 ml by the Canadian Standard Freeness test, which values are typical of a pine linerboard pulp prior to beating.

A dispersion of the pulp in distilled water was converted to handsheets using a TAPPI sheet mold. The quantity of fiber in the dispersion was adjusted to give a TAPPI sheet weight of 3.6 g in the oven dried state, said weight being close to that of an air dried, 42 lb/1000 ft$^2$ (250 g/m$^2$) commercial linerboard sheet. The sheets were wet pressed with blotters at 60 psi (415 kPa) prior to drying.

Three sets of sheets were prepared. Sheets from the first set were dried on TAPPI rings at room temperature according to TAPPI standard T205 om-81. This is a conventional (C) drying procedure. Sheets from the second set were also dried by the conventional procedure but this procedure was followed by a heat treatment (HT). The paper sheet was placed between to two 150 mesh stainless steel screens, which assembly was placed in the platen press. Heat treatment was in accordance with the conditions found optimum for this invention, namely 2 seconds at 550° F. (289° C.) sheet internal temperature. To do this, single sheets were placed in a 550° F. (289° C.) Carver platen press for 4 seconds with 15 psi (105 KPa) as applied pressure. Previous experiments using a thermocouple buried in the sheet had shown that the sheet required 2 seconds to reach the target 550° F. (289° C.) temperature. Individual sheets from the third set were inserted in the wet state in a different platen press at 280° F. (138° C.). A pressure of 15 psi ( 105 KPa) was maintained for 5 seconds to dry surface fibers, after which the pressure was increased to 790 psi (5450 KPa) for 20 seconds. On completion of this press densification process (PD) sheet moisture was about 10%. Each sheet was removed from the PD press and immediately placed in the other, HT press for 4 seconds at 550° F. (289° C.). All three sets of sheets were conditioned at 73° F. (23° C.) and 50% humidity for at least 24 hours before testing.

Fold, wet and conditioned tensile strength and conditioned compressive strength were the tests that were carried out. Wet tensile tests were carried out immediately after excess water was blotted from test sheets which had been removed after 4 hours immersion in distilled water. Otherwise, this test was the same as the TAPPI standard dry tensile test.

The result summarized in Table I show superior folding endurance and wet strength for the densified and heat treated sheets.

TABLE I

COMPARISON OF PINE LINERBOARD HANDSHEETS AFTER THE C, THE C + HT AND PD + HT PROCEDURES

| Treatment | Density kg/m³ | Fold | Compressive Strength lb/in | Compressive Strength (KN/m) | Tensile Strength lb/in | Tensile Strength (KN/m) | Wet Tensile Strength lb/in | Wet Tensile Strength (KN/m) |
|---|---|---|---|---|---|---|---|---|
| C | 649 | 1714 | 31 | (5.43) | 73 | (12.78) | 2.7 | (0.47) |
| C + HT | 635 | 643 | 44 | (7.71) | 84 | (14.71) | 24.2 | (4.24) |
| PD + HT | 775 | 1115 | 44 | (7.71) | 94 | (16.46) | 26.0 | (4.55) |

EXAMPLE 2

Hardwood chips from the southeastern United States were cooked by the kraft process to yield, after disk refining and washing, a 98 kappa pulp of 618 ml Canadian Standard Freeness. This pulp was mixed with the softwood of example 1 to give a mixture containing 60% softwood and 40% hardwood fiber. Sheets were prepared and tested following the procedure in Example 1. The superior fold and strength properties that were obtained are given in Table II.

TABLE II

COMPARISON OF PINE/HARDWOOD LINERBOARD HANDSHEETS AFTER THE C, THE C + HT AND PD + HT PROCEDURES

| Treatment | Density kg/m³ | Fold | Compressive Strength lb/in | Compressive Strength (KN/m) | Tensile Strength lb/in | Tensile Strength (KN/m) | Wet Tensile Strength lb/in | Wet Tensile Strength (KN/m) |
|---|---|---|---|---|---|---|---|---|
| C | 546 | 831 | 25 | (4.38) | 57 | (9.98) | 2 | (0.35) |
| C + HT | 569 | 462 | 36 | (6.30) | 63 | (11.03) | 15 | (2.63) |

TABLE II-continued

COMPARISON OF PINE/HARDWOOD LINERBOARD HANDSHEETS AFTER THE C, THE C + HT AND PD + HT PROCEDURES

| Treatment | Density kg/m³ | Fold | Compressive Strength lb/in | Compressive Strength (KN/m) | Tensile Strength lb/in | Tensile Strength (KN/m) | Wet Tensile Strength lb/in | Wet Tensile Strength (KN/m) |
|---|---|---|---|---|---|---|---|---|
| PD + HT | 701 | 1032 | 39 | (6.83) | 73 | (12.78) | 17 | (2.98) |

EXAMPLE 2A

Pine wood chips were processed into a pulp as in Example 1, first paragraph. A dispersion of the pulp in distilled water was converted to handsheets using a Noble & Wood sheet mold. The quantity of fiber in the dispersion was adjusted to give a TAPPI sheet weight of 7.9 g in the oven dried state. The sheets were wet pressed with blotters at 50 psi (346 kPa) prior to drying.

Three sets of sheets were prepared. Sheets from the first set were dried on a rotary drum dryer in a conventional (C) manner. Sheets from the second set were heat treated (HT) as in Example 1, and sheets from the third set were densified and then heat treated (PD & HT) as in Example 1. One sample from each set was conditioned at 73° F., 50% relative humidity ("dry"); another sample was conditioned at 90° F., 90% relative humidity ("moist"). Folding endurance, wet tensile strength and compressive strength test were then carried out as in Example 1. The results, summarized below, show a marked improvement in both folding endurance and in tensile and compressive strength in high moisture conditions.

TABLE IIA

COMPARISON OF PINE LINERBOARD HANDSHEETS UNDER HIGH MOISTURE CONDITIONS

| Treatment | Density kg/m³ | Fold | Compressive Strength "Dry" lb/in | Compressive Strength "Dry" KN/m | Compressive Strength "Moist" lb/in | Compressive Strength "Moist" KN/m | Wet Tensile Strength |
|---|---|---|---|---|---|---|---|
| C | 412 | 441 | 17.7 | (3.1) | 10.2 | (1.8) | 1.8 (0.3) |
| C & HT | 503 | 681 | 36.1 | (6.3) | 18.9 | (3.3) | 21.7 (3.8) |
| PD & HT | 843 | 1878 | 37.6 | (6.6) | 24.0 | (4.2) | 27.1 (4.7) |

EXAMPLE 3

The pine pulp used in Example 1 was subjected to three levels of beating by multiple passes through an Escher Wyss refiner to decrease the freeness of the pulp. Sheets were prepared and tested at each process level following the procedure in Example 1. The results in Table 3 again clearly demonstrate the lack of brittleness of the PD+HT sheets in comparison with sheets treated by the C+HT procedure.

TABLE III

COMPARISON OF THE PINE LINERBOARD PULP SHEET PROPERTIES AFTER 3 LEVELS OF BEATING

| Canadian Standard Freeness (mls) | Treatment | Density Kg/m³ | Fold | Compressive Strength lb/in (KN/m) | Tensile Strength lb/in (KN/m) | Wet Tensile Strength lb/in (KN/m) |
|---|---|---|---|---|---|---|
| 605 | C | 694 | 2037 | 38 (6.65) | 80 (14.1) | 3 (0.53) |
| 605 | C + HT | 697 | 866 | 47 (8.23) | 82 (14.36) | 27 (4.73) |
| 605 | PD + HT | 766 | 1315 | 48 (8.40) | 85 (14.89) | 30 (5.25) |

TABLE III-continued

COMPARISON OF THE PINE LINERBOARD PULP SHEET PROPERTIES AFTER 3 LEVELS OF BEATING

| Canadian Standard Freeness (mls) | Treatment | Density Kg/m³ | Fold | Compressive Strength lb/in (KN/m) | Tensile Strength lb/in (KN/m) | Wet Tensile Strength lb/in (KN/m) |
|---|---|---|---|---|---|---|
| 505 | C | 753 | 2372 | 41 (7.18) | 89 (15.58) | 3 (0.53) |
| 505 | C + HT | 737 | 625 | 50 (8.76) | 88 (15.41) | 31 (5.43) |
| 505 | PD + HT | 770 | 1277 | 47 (8.23) | 90 (15.76) | 33 (5.78) |
| 420 | C | 761 | 2536 | 40 (7.00) | 89 (15.58) | 3 (0.53) |
| 420 | C + HT | 748 | 920 | 47 (8.23) | 87 (15.23) | 29 (5.08) |
| 420 | PD + HT | 801 | 1117 | 50 (8.76) | 94 (16.46) | 38 (6.65) |

These values may be compared to those shown in Table I, for unbeaten pulp (720 Canadian Standard Freeness).

EXAMPLE 4

On a conventional linerboard machine, three hard covered 12" diameter press nip rolls were located on drier cans #43, 45 and 47. Furnish of 100% softwood kraft pulp was run on the machine and a 42 lb/1000 ft² (205 g/m²) basis weight linerboard was obtained at a speed of 1550 ft/min. (473 m/min.). No nip pressure was applied to the nip rolls mentioned during the first stage of the trial and with conventional drying temperature, properties outlined below in Table IV were obtained. In the table, "MD" denotes testing along the machine length; "CD" denotes testing across the machine width.

TABLE IV

CONVENTIONAL

| | | | |
|---|---|---|---|
| Basis Weight | | = | 42 lb/1000 ft² (205 g/m²) |
| Caliper | | = | 11.3 mils (.276 mm) |
| Density | | = | 713 kg/m³ |
| Double Fold | MD | = | 2043 |
| | CD | = | 1493 |
| Compression Strength | MD | = | 39.1 lb/in (6.85 KN/m) |
| | CD | = | 21.9 lb/in (3.84 KN/m) |
| Dry Tensile | MD | = | 87.6 lb/in (15.3 KN/m) |
| | CD | = | 39.9 lb/in (6.99 KN/m) |
| Wet Tensile | MD | = | 10.1 lb/in (1.77 KN/m) |
| | CD | = | 4.8 lb/in (0.84 KN/m) |

When this board was subject to high temperature treatment of 464° F. for 30 seconds, properties shown in Table V were obtained.

TABLE V

HEAT TREATED

| | | | |
|---|---|---|---|
| Basis weight | | = | 42 lb/1000 ft² (205 g/m²) |
| Caliper | | = | 11.3 mil (.276 mm) |
| Density, | | = | 713 kg/m³ |
| Double Fold | MD | = | 15 |
| | CD | = | 92 |
| Compression Strength | MD | = | 48.0 lb/in (3.41 KN/m) |
| | CD | = | 19.6 lb/in (3.43 KN/m) |
| Dry Tensile | MD | = | 92.0 lb/in (16.11 KN/m) |
| | CD | = | 42.0 lb/in (7.36 KN/m) |
| Wet Tensile | MD | = | 36.0 lb/in (6.30 KN/m) |
| | CD | = | 17.1 lb/in (2.99 KN/m) |

The increase in wet strength, coupled with the very great reduction in folding endurance, conform to prior art experience. To test the effect of densification, the press nip rolls were then activated. A force of 230 pli (41 kg/cm) gave a nip pressure of 1225 psi (8445 KPa) and when three pressure nips were applied, the densified board gave test results as follows:

TABLE VI

DENSIFIED

| | | | |
|---|---|---|---|
| Basis weight | | = | 42 lb/1000 ft² (205 g/m²) |
| Caliper | | = | 10.5 mil (.266 mm) |
| Density | | = | 769 |
| Double Fold | MD | = | 2025 |
| | CD | = | 1244 |
| STFI | MD | = | 42.3 lb/in (7.41 KN/m) |
| | CD | = | 23.6 lb/in (4.13 KN/m) |
| Dry Tensile | MD | = | 89.0 lb/in (15.59 KN/m) |
| | CD | = | 44.6 lb/in (7.81 KN/m) |
| Wet Tensile | MD | = | 18.2 lb/in (3.18 KN/m) |
| | CD | = | 10.7 lb/in (1.87 KN/m) |

The densified board was then heat treated at 464° F. for 20 seconds. The following results were obtained.

TABLE VII

DENSIFIED AND HEAT TREATED

| | | | |
|---|---|---|---|
| Basis weight | | = | 42 lb/1000 ft² (205 g/m²) |
| Caliper | | = | 10.2 mil (.266 mm) |
| Density | | = | 789 |
| Double Fold | MD | = | 1450 |
| | CD | = | 1142 |
| STFI | MD | = | 46.9 lb/in (8.21 KN/m) |
| | CD | = | 26.1 lb/in (4.57 KN/m) |
| Dry Tensile | MD | = | 92.0 lb/in (16.11 KN/m) |
| | CD | = | 49.0 lb/in (8.58 KN/m) |
| Wet Tensile | MD | = | 34.1 lb/in (5.47 KN/m) |
| | CD | = | 17.7 lb/in (3.09 KN/m) |

The unexpected lack of brittleness (as measured by the folding endurance test) of the densified and heat treated product (Table VII) when compared with the other high wet strength paperboard (Table V) can be identified as a direct result of the sequence of densification and high temperature treatment.

EXAMPLE 5

To illustrate the effect of densification prior to conventional or dynamic press drying, handsheets were prepared from a 60% softwood, 40% hardwood high yield pulp blend of the linerboard type. The sheets were divided into two main groups. The first group of sheets were wet pressed at an intensity level approximating that in a conventionally equipped production machine wet press (CWP). The second group were pressed at an intensity level approximating that of a modern production machine equipped with a shoe press (SP).

Each group of sheets was further subdivided into individual sheets which were retained for testing after drying on a steam-heated rotating drum, or press drying by passage through the nip between a press roll and the rotating drum, or by static press drying between 150 mesh stainless steel screens at 465° F. for 30 seconds with 15 psi pressure applied by means of a suitable press.

Heat treated control sheets which had been subjected to conventional wet pressing (CWP) and drying on the rotating drum had high caliper. Such thick sheets have minimal fiber-fiber contacting points. As adhesive forces develop at such points during drying, minimal contacting points result in poor folding endurance and wet tensile strength properties after heat treatment. Densification by use of the shoe press gave lower caliper and improved contact between fibers, and wet strength also increased. Dynamic press drying gave somewhat more efficient densification and provided a further improvement in wet tensile strength. The combination of shoe wet pressing and dynamic press drying provided further improvements after heat treatment. The final data in the table show what can be obtained by application of static press drying followed by heat treatment of sheets which had been subjected to the shoe pressing procedure.

TABLE VIII

EFFECT OF DENSIFICATION ON FOLDING ENDURANCE AND WET TENSILE STRENGTH OF 46 lb/ft$^2$ HEAT TREATED HANDSHEETS

| Process | Caliper (mils) | Density (kg/m$^3$) | Double Fold | Wet Tensile Strength (lb/in) |
|---|---|---|---|---|
| CWP - no HT drum dried w/o press | 19.4 | 457 | 30 | 2.7 |
| CWP - HT drum dried w/o press | 19.19 | 445 | 198 | 11.3 |
| SP - HT drum dried w/o press | 13.3 | 665 | 543 | 12.3 |
| CWP press dried, HT | 11.1 | 797 | 631 | 12.5 |
| SP press dried, HT | 10.7 | 827 | 725 | 14.6 |
| SP static press dried, HT | 11.8 | 750 | 572 | 17.8 |

Inasmuch as the invention is subject to various changes and variations, the foregoing should be regarded as merely illustrative of the invention defined by the following claims.

We claim:

1. A method of maximizing the folding endurance of linerboard produced from unbleached kraft pulp while improving its wet strength by heat treatment, comprising the steps of forming a wet web of cellulose fibers from an aqueous suspension of fibers; then, without first drying the web, press drying said wet web, by compressing it sufficiently to produce a product having a density of at least 700 kg/m$^3$ and drying the product until its water content by weight is less than 10%, and then heat treating the product at an internal temperature of at least 420° F. (216° C.) for a time sufficient to increase the wet strength thereof.

2. The method of claim 1, wherein said heat treating step is for a duration sufficient to produce a wet strength of at least 15 pounds per inch.

3. The method of claim 1, wherein said internal temperature is in the range of 420° F. (216° C.) to 572° F. (300° C.).

4. The method of claim 1, wherein said internal temperature is about 550° F. (289° C.).

5. The method of claim 1, wherein said densification includes applying sufficient pressure to the paper to produce density in range of 700–900 kg/m$^3$ prior to said heating step.

6. The method of claim 1, wherein said paper product is linerboard.

7. The method of claim 6, wherein said linerboard has a basis weight in the range of 125 to 464 g/m$^2$.

8. The method of claim 6, wherein said linerboard has a basis weight of about 203 g/m$^2$.

9. A linerboard of high wet strength and high folding endurance, produced according to any one of claims 3, 4, 5, 6, 7, 8 or 1.

10. A linerboard as in claim 9, having a wet strength of at least 15 lb/in, and satisfying a folding endurance test of a at least 1000 cycles.

11. A linerboard as in claim 9, having a wet strength of at least 15 lb/in, and satisfying a folding endurance test of at least 300 cycles.

* * * * *